US007655853B1

(12) United States Patent
Ricca

(10) Patent No.: US 7,655,853 B1
(45) Date of Patent: Feb. 2, 2010

(54) WEIGHT-RELIEVING DEVICE FOR A WOODWIND INSTRUMENT

(76) Inventor: Tom L. Ricca, 1413 Wyandotte Rd., Columbus, OH (US) 43212

( * ) Notice: Subject to any disclaimer, the term of this patent is extended or adjusted under 35 U.S.C. 154(b) by 0 days.

(21) Appl. No.: 12/322,270

(22) Filed: Jan. 30, 2009

(51) Int. Cl.
*G10D 7/08* (2006.01)

(52) U.S. Cl. ..... 84/385 A

(58) Field of Classification Search ..... 84/380 R, 84/385 A, 387 A; 248/167, 682, 443; 206/314
See application file for complete search history.

(56) References Cited

U.S. PATENT DOCUMENTS 6,384,307 B1 * 5/2002 Sueta et al. ..... 84/385 A
7,282,631 B2 * 10/2007 Chou ..... 84/385 A

* cited by examiner

*Primary Examiner*—Kimberly R Lockett

(57) ABSTRACT

A device relieves the weight on the thumbrest of a woodwind instrument that does not have a curved neck near the mouthpiece, thereby avoiding muscular strain and soreness in the right hand and thumb of the instrument player without altering negatively the instrument playing in the conventional ways. This device includes a strap 20 that suspends on the player's chest an enclosure 30 housing a constant-force spring 34 coupled with a coil of cord 40 which terminates outside of this enclosure in a snap-hook 60 that is secured onto the thumbrest ring 70 of the instrument. In usual playing positions that point the instrument to the ground, the device creates a physical force component on the thumbrest in line with but opposite to the weight of the instrument on the thumbrest and thus diminishes in a perceivable manner the stress of the instrument weight on the right-hand of the player.

17 Claims, 9 Drawing Sheets

WEIGHT-RELIEVING DEVICE FOR A WOODWIND INSTRUMENT

BACKGROUND

1. Field

This application relates to a novel method and device to provide a perceivable relief from the weight on the right thumb of a player of a woodwind musical instrument that does not have a curved neck near the mouthpiece.

2. Prior Art

A particular group of reed woodwind musical instruments characterized by the oboe, clarinet, oboe d'amore, English horn, basset clarinet and straight soprano saxophone are small enough to be made essentially rectilinear from one end to the other. However, due to the intricate amount of key work, the weight of these instruments in playing position is usually greater than the amount that occurred in their primitive ancestors. In present-day forms, they are all made with a conventional thumbrest located on each instrument at a location that approximately allows the right-hand thumb of the player to support the instrument while allowing the other fingers of the right hand to manipulate the different keys or tone holes of the instrument in playing. The left-hand thumb in playing these instruments is assigned the task of acting on at least one key that produces the higher-register notes in combination with the action of the other fingers of both hands. Thus, the left-hand thumb provides practically none of the support against the weight of the instruments, because its position on the instruments is completely away from the center of gravity of the instruments in the usual playing positions. The left-hand thumb initiates the instruments into playing position. In addition, it assists the player's embouchure, defined in the art as the formation of the player's lips and teeth around the mouthpiece of the instruments, thus stabilizing the instruments during playing. It is well known to any player that balancing one of these instruments with the delicate embouchure and the fingers of both hands against the weight of the instrument requires a great amount of skill to be acquired through hours of practice and constantly increasing pain in the right-hand thumb that has to support the majority of the weight of the instrument.

Further analysis reveals that the player's embouchure cannot contribute generally to support the weight of the instrument because it is far away in all usual playing positions from the center of gravity of the instrument. Practically the total weight of an instrument in this particular group during playing is supported by the thumb of the player's right hand. Consequently, with just a conventional thumbrest on an instrument of the group, considerable strain in the right hand and its thumb is felt by the professional, amateur or student musician players, during prolonged musical performances or practice sessions. The strain may become so unbearable that it hinders the ability to play the instrument. Continuous strain can cause severe repetitive-strain syndrome in the right wrist and known to have compromised or terminated promising musical careers or cause considerable frustration of many players who are unable to produce the unique musical sounds that they aspire for themselves in playing one of these instruments.

One of the most obvious and successful methods of relieving the weight of any woodwind musical instrument in playing position is to use a supporting strap. One way is to anchor the strap comfortably around the neck. Another way is to wear the strap around the back on one or both shoulders such as found on a class of very heavy bassoons, contra-bassoons, bass clarinets or saxophones of any size with a pronouncedly curved neck near the mouthpiece. These successful straps include a hook which fits through a ring integrally formed on the thumbrest of this class of instruments. The length of the straps is adjustable into a fixed amount by each experienced individual player before playing and would not need any further adjustment during playing. However, when these successful straps are similarly designed into straps for the group of instruments characterized by an oboe and a clarinet, these latter straps are known to be rejected by any experienced player as not helpful at all, and even considered dangerous. The cause of this peculiar poor performance becomes obvious when the players have had the time or a chance to evaluate these latter straps with some engineering analysis. The cause of success of the straps of the group characterized by the bassoons and saxophones with a curved neck is that the mouthpiece on all of these instruments is oriented in a way that when a strap's length is properly adjusted by an experienced player for the proper angle or any other angle of playing, the right thumb of the player just has to push the thumbrest away from the player's body to reduce the pressure of the weight on the right thumb. Because of the strap, these curved-neck instruments can only move the mouthpiece up in an arc in front of the player and into the player's embouchure more or less precisely for playing but not haphazardly to the point of jamming the reed into the player's lips or teeth in an unexpectedly constrained manner.

Observing the success of this group of straps leads to the understanding of the real cause of poor performance of the straps designed for the group characterized by the oboes and clarinets: that is, the lack of a curved neck near the mouthpiece on these instruments. Regardless of being adjusted by an experienced or novice player, when the fixed length of the strap of this group of instruments is determined, the weight relief on the right thumb is perceived only through a definite small arc described by the thumbrest around one point on the back of the neck of the player with the radius defined by the already-fixed length of the strap. The only way to continue to perceive the weight relief on the right thumb and to suitably position the instrument mouthpiece to the player's embouchure is governed by two constraints. First, move the thumbrest so that it would be at the maximum distance from the back of the player's neck determined by the already-fixed length of the strap. Next, make the angle of the straight body of the instrument and the straight line formed by the strap between the back of the player's neck and the thumbrest to be the same angle that was chosen during the preliminary adjustment of the strap. It can be appreciated that satisfying both of these constraints at the beginning and during playing one of these instruments with the correct embouchure is very difficult and exasperating. Moreover, one can imagine intuitively that satisfying strictly the first constraint while not satisfying the second can lead easily to the danger of jamming the reed into the player's lips or teeth accidentally with regrettable consequences.

To counter the detrimental effect of the weight of the instruments on the playing, prior art pointed to some solutions. A few embodiments concentrate on providing maximum comfort in the thumbrest by way of suitable cushioning or ergonometrically orienting the right-hand thumb in playing position. These embodiments are found in U.S. Pat. No. 2,803,983 to Dowling, No. 2,847,892 to Laas et al, No. 2,933,968 to Hearne, Jr, No. 3,988,958 to Brunkow, and No. 4,348,935 to Bay. A few others such as U.S. Pat. No. 3,192,817 to Schmidt, No. 4,841,829 to Lehmann, and No. 6,759,584 to Sundström proposed to shift the weight of the instrument in playing from the right-hand thumb to another part of the body of the player. Some of these embodiments are improvements upon the conventional thumbrest, but the main problem of the instrument's weight on the right thumb and right arm is still there.

Other U.S. Patents such as U.S. Pat. No. 5,050,827 to Christie, and No. 3,357,666 to Smith et al proposed to shift the weight of the instrument onto an extendable monopod support which is attached to the instrument to project straight to the floor, The rigid support constrains the instrument to be playable only in a stationary position which restricts in a conspicuous manner the players who naturally would like to express artistic style by moving while playing the instrument and forces their embouchure to be changed from the best formation most of the time.

Another U.S. Pat. No. 5,664,758 to Smith, proposed to shift the weight of the instrument onto an extendable monopod strut device that bears in its lower end on a seating facility upon which the player is seated or on a pouch located on the body of the player in later commercial embodiments. This patent allows only very limited movements of the head and upper body of the players in playing sessions even in the most advanced embodiment. It requires precision assembly of thin telescopic tubings and complicated adjusting mechanisms in all its embodiments and thus is fragile and expensive. It also requires different sizes for different age groups of users.

In spite of several attempts in prior art, no one can provide the complete solution to the problem of relieving the weight on the right-hand thumb of a player in playing one of the musical woodwind instruments that do not have a curved neck near the mouthpiece such as oboes, clarinets, oboes d'amore, English horns, basset clarinets or straight soprano saxophones. This complete solution includes the low cost of ownership, simplicity and non-intrusiveness in use, reliability, durability, fast set up before use, instantaneous adjustment to differences in size and changes in player's natural position and movements during playing, resting or going on stage, and aesthetically blending into the appearance of the instrument. The present invention aims at providing this complete solution without causing any hindrance to the playing of these instruments in other respects.

SUMMARY

In accordance with one embodiment a weight-relieving device for woodwind instruments comprises a neck strap suspending at its two ends a housing of force potential that provides a suitable pulling force toward this housing on a hook when this hook which terminates a cord contained in this housing is extended out to be secured onto a ring which is attached onto the conventional thumbrest of a woodwind musical instrument of a group that does not have a curved neck near the mouthpiece that includes an oboe, a clarinet, an oboe d'amore, an English horn, a basset clarinet or a straight soprano saxophone.

The reader can appreciate more completely the present invention and its scope from the accompanying drawings that are briefly described below, from the following detailed description of different embodiments of the invention, and from the appended claims.

In the drawings, closely related figures have the same number but different alphabetic suffixes.

DRAWINGS

Figures

FIG. 1 shows a player of a modern B-flat clarinet using one embodiment of the application.

FIG. 2A magnifies the details of this embodiment.

FIG. 7 shows one implementation of a thumbrest ring attachment that is used by all embodiments of the application, to be mechanically secured onto the instruments' thumbrest which does not have an inherent metal ring soldered on.

DETAILED DESCRIPTION

First Embodiment

Figure 1:
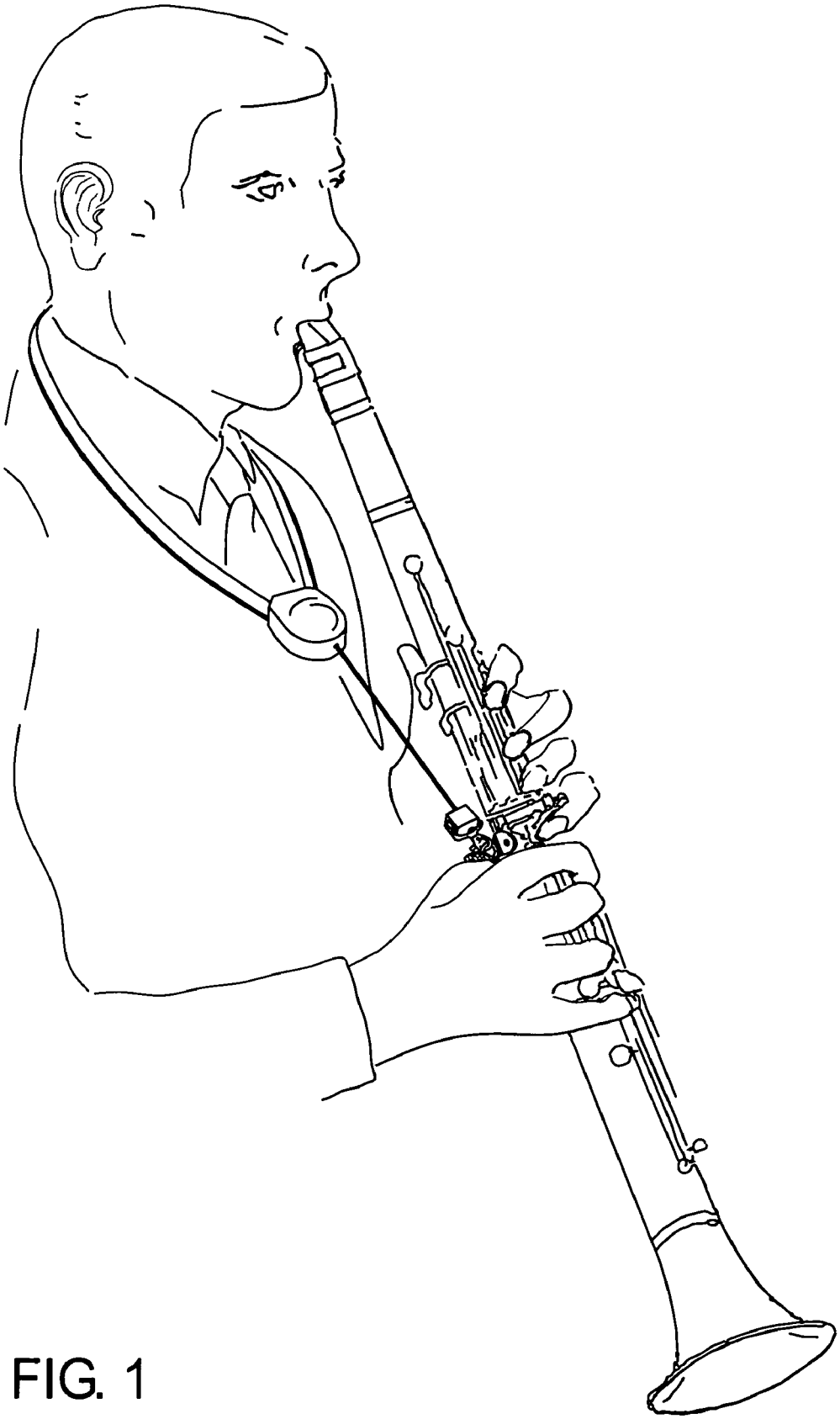

One embodiment of the weight-relieving device for woodwind instruments is illustrated in FIG. 1. An average adult is shown to play a clarinet of the size called B-flat type, while using this first embodiment to relieve the strain on his right thumb. This B-flat clarinet is the single most popular reed woodwind instrument among different age groups of players. Its weight and size is exactly the same for all sizes of players, from grade-school kids to any of the big-size adults. The weight of this instrument is about the average of that of all the reed woodwind instruments which are small enough to be made economically in a relatively straight form from one end to the other. The heaviest among this group of instruments, the soprano saxophones, are still thought to be within the range of weight that can be supported by a right-hand thumbrest placed at about the middle of each instrument.

Figure 2A:
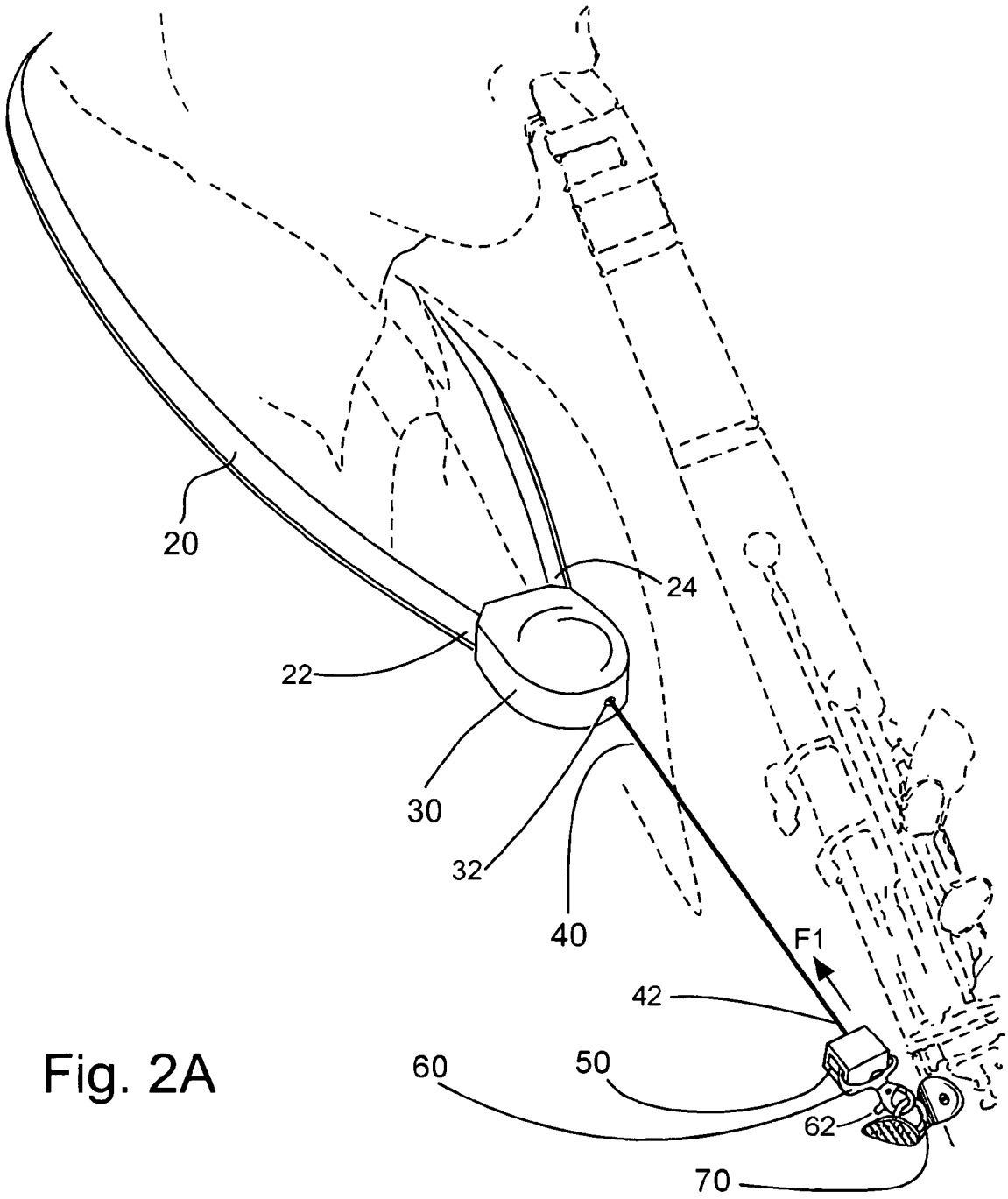
FIG. 2B shows a practical arrangement inside the cord housing of this embodiment.
Figure 2B:
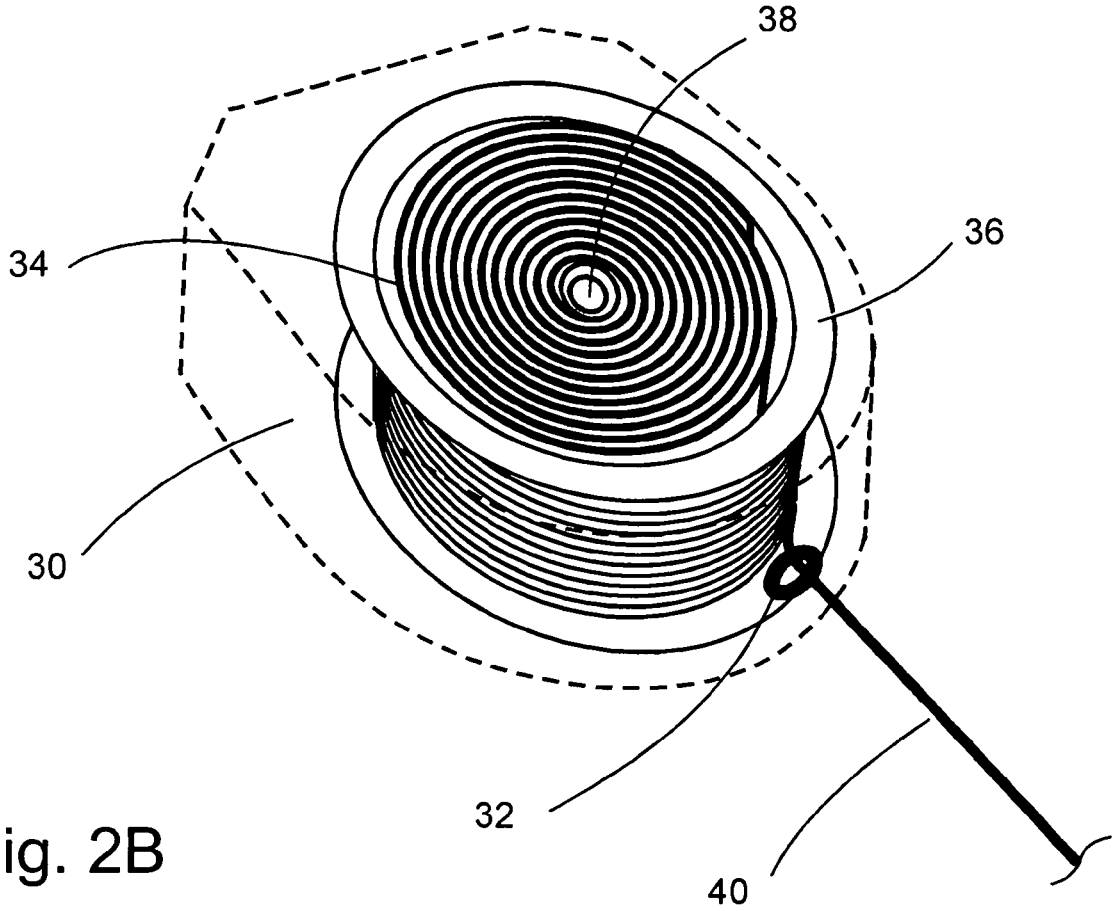

The details of this first embodiment are magnified in FIG. 2A. The weight-relieving device has a strap 20 of suitable width and length, and of suitable material to be comfortable in contact with the skin, at the same time strong, durable, flexible but not substantially extensible, and aesthetically blending into the look of the player and instrument. In the preferred embodiment, this strap is wrapped around the player's neck and one or both ends 22 and 24 of this strap can be easily and quickly secured onto or removed from a cord housing 30 located on the chest of the player. Referring to FIG. 2B this cord housing contains within its enclosure a bobbin 36 that is attached within its cylindrical cavity and at one point on its cylindrical wall the outermost end of a coil of flat spring material in the configuration of a constant-force spring. The innermost end of this spring is attached to an axial rod 38 which is parallel to the rectilinear direction of cylindrical bobbin 36. This axial rod is a fixed part of the cord housing and made in a way that would allow bobbin 36 to rotate freely and without too much play around it. A cord 40 is arranged to be wound in an orderly manner around bobbin 36. This cord is of suitable length, is strong, and flexible enough to support in multiple times the weight of a typical instrument of the group with great durability. It can be made of a material such as steel braid enrobed in a formulation of plastic commonly known as nylon. When rotating, the bobbin will allow the cord to extend up to its maximum length or retract the cord completely inside the housing. Bobbin 36, made with a low-friction material such as acetal or polyethelene, is to rotate in the direction of retracting the cord into the housing on the urging of constant-force spring 34. In the preferred embodiment, this constant-force spring is made of material of suitable durability and strength to make the bobbin rotate to exert in turn a practically constant pulling force F1, shown as a vector in FIG. 2A, on the cord at any of its extent with the design of retracting the cord back into the housing if the cord is allowed to do so intentionally by the user of the embodiment. In this preferred embodiment, this constant pulling force is calibrated to be always less than the force of the weight of the instrument by a calculated amount. Cord 40 is made to exit the housing through an aperture 32 of the housing and terminate securely at its end 42 in a snap-hook base 50 as shown in FIG. 2A. This snap-hook base is made with material of suitable strength, durability and configuration so that it will conveniently secure onto itself a snap-hook 60 through a closed loop of this snap-hook. Snap-hook 60 can be acquired as one of the readily available items provided by the industries in different metal technologies or different kinds of plastics of suitable strength. Snap-hook 60 has a clip-tab 62 that can be actuated by the right-hand index finger tip to open its hook to wrap part of the hook around the ring 70 and then to snap-close the hook completely around ring 70 securely when clip-tab 62 is released by the finger tip. Ring 70, or an equivalent part described later on, is attached securely onto the thumbrest, conventional or otherwise, of the instrument to be played, by brazing, soldering or mechanical assembly. Clip-tab 62 can be actuated by an index finger of a hand to open the snap-hook subsequently at the right time to release the snap-hook from ring 70 while the other fingers of the hand hold securely the other parts of the snap-hook 60. In this first embodiment, cord housing 30 can be considered technically as a force potential source. When designed correctly, it has the potential of pulling on the snap-hook 60 via cord 40 with a relatively constant force regardless of whether snap-hook 60 is closest to housing 30 or a few feet away from it.

Operation—FIGS. 2A and 2B

The manner of using the weight-relieving device on a woodwind instrument of the group of instruments that include oboes, clarinets, oboes d'amore, basset clarinets, English horns, and straight soprano saxophones comprises quick steps of assembly that can be varied or simplified further when experience in using the embodiment is increased. Referring to FIG. 2A, the steps are as follows:

One, secure strap end 24 onto a designated part (not shown) of the housing 30.

Two, loop the strap around the left side of the player's neck so that it falls down over the player's right shoulder.

Three, secure strap end 22 onto another designated part (not shown) of housing 30.

Four, with the housing 30 hanging by the strap 20 around the neck and in front of the chest of the player's, manipulate the strap 20 so that it will lie flat around the player's neck, benefiting from the swiveling arrangements (not shown) at ends 22 and 24 of strap 20.

Five, holding the instrument with the left hand, expose the area of thumbrest ring 70.

Six, grab snap-hook base 50 together with snap-hook 60 with the right hand, index finger tip of the right hand being on clip-tab 62.

Seven, move the right hand so that the snap-hook is near the ring 70, extending in the process the cord 40 from housing 30 by a necessary length with the right hand feeling drastically a resisting force along the cord against the moving of the snap-hook away from housing 30.

Eight, exercise the index-finger tip on the clip-tab 62 to open snap-hook 60, then hook it around thumbrest ring 70, before closing the snap-hook by removing the index-finger tip from the clip-tab 62.

All these eight steps can be taken by a teacher to assemble this embodiment of the weight-relieving device on a young student's body and instrument for the first few times, or by any player who can follow the written instructions accompanying the commercial implementation of the embodiment.

Now, the player can hold the instrument with both hands in the familiar manner and put the instrument into playing position by raising the whole instrument with the right-hand thumb and by tilting the instrument around the thumbrest, naturally, with the left hand, and by visually guiding with total freedom the mouthpiece of the instrument with both hands into the embouchure. Owing to the combination of the suitable length of strap 20, the suitable constant pulling force on cord 40 on the thumbrest, and the generally adopted playing positions of the instruments pointing to the ground, this total freedom is realizable for the player. This freedom experienced by the player in raising the instrument into playing position and during playing at any angle pointing the instrument to the ground, is the sensation of no strange force in any direction on the two hands except the familiar force of the weight pushing down on the right thumb. However, this force would be drastically diminished due to the real physical force resulting between of the original force on the thumb before the adoption of the embodiment, and the well calculated up-pulling force that the embodiment is vigilantly exerting now on the thumbrest. This up-pulling force creates physically a component force in line with but opposite to the gravity force of the weight of the instrument on the thumbrest, and thus will diminish the weight gravity force by an intended amount to provide a perceivable relief on the right thumb of the player.

Players of the commercial form of the embodiment would be cautioned about using the embodiment while playing with the instruments pointing into any direction above their horizontal position. Intuitively, the reader can see that in these playing positions, a component of the resulting force between the weight of the instrument on the thumbrest and the pulling force of the embodiment on the thumbrest is directed toward the embouchure. The player should then consciously control the instrument with the embouchure and stabilizing the instrument with at least a thumb and a finger of the left or right hand in a way that the playing still can be continued in the presence of this force toward the embouchure. This last force is essentially higher than the same directional force in those positions before the adoption of the embodiment. These measures of precaution should not be any problem for experienced players who may go into these angles of playing only during some particular moments of music presentation.

The combination of a suitable length of strap 20 and the size of the cord housing governs the manner in which the same components of the embodiment serve all users of different ages and body sizes. This combination should have the provision for the snap-hook base 50 to have the chance to be pulled away from the cord housing a few inches in all playing angles of the instrument when played by the smallest foreseeable player. This provision is for the embodiment to provide the beneficial up-pulling constant force on the thumbrest in all the most usual playing positions while the length of the cord adjusts itself instantly to any necessary extension to balance the delicate embouchure formation against the moving angles of the instrument with respect to the body of the player. Such a combination, in turn, would naturally provide this beneficial weight relief on the thumbrest for all other larger-sized players who play necessarily the exact same size of instrument due to the precise construction of the instrument to have the same tuning range and same tonality of timbre.

The use of a constant-force spring to cause the up-pulling force on the thumbrest affords the unique opportunity to provide this embodiment with a cord of more than 30 inches easily, long enough to allow a soloist to assemble the embodiment securely hooked to the thumbrest of an instrument and go on stage naturally, walking elegantly with the instrument on hand in front of the chest or on the side of the body. Then, at the right moment, this soloist can raise the instrument and begin to play without any further awkward steps of assembly of the instrument or accessories. In general, this long cord allows a player to rest the instrument on the knees without having to unhook the snap-hook from the thumbrest, while waiting to begin to play again. In all situations where the cord is extended at any length, the weight of the instrument on the thumbrest which is practically its center of gravity, still is a little bit greater than the pulling force of the embodiment on the thumbrest, so that even when a player carelessly lets go of the instrument, it would not be falling easily onto the ground or getting pulled up suddenly without the intentional manual raising action of the player.

FIG. 3A, 3B, 3C

Additional Embodiments

Figure 3A:
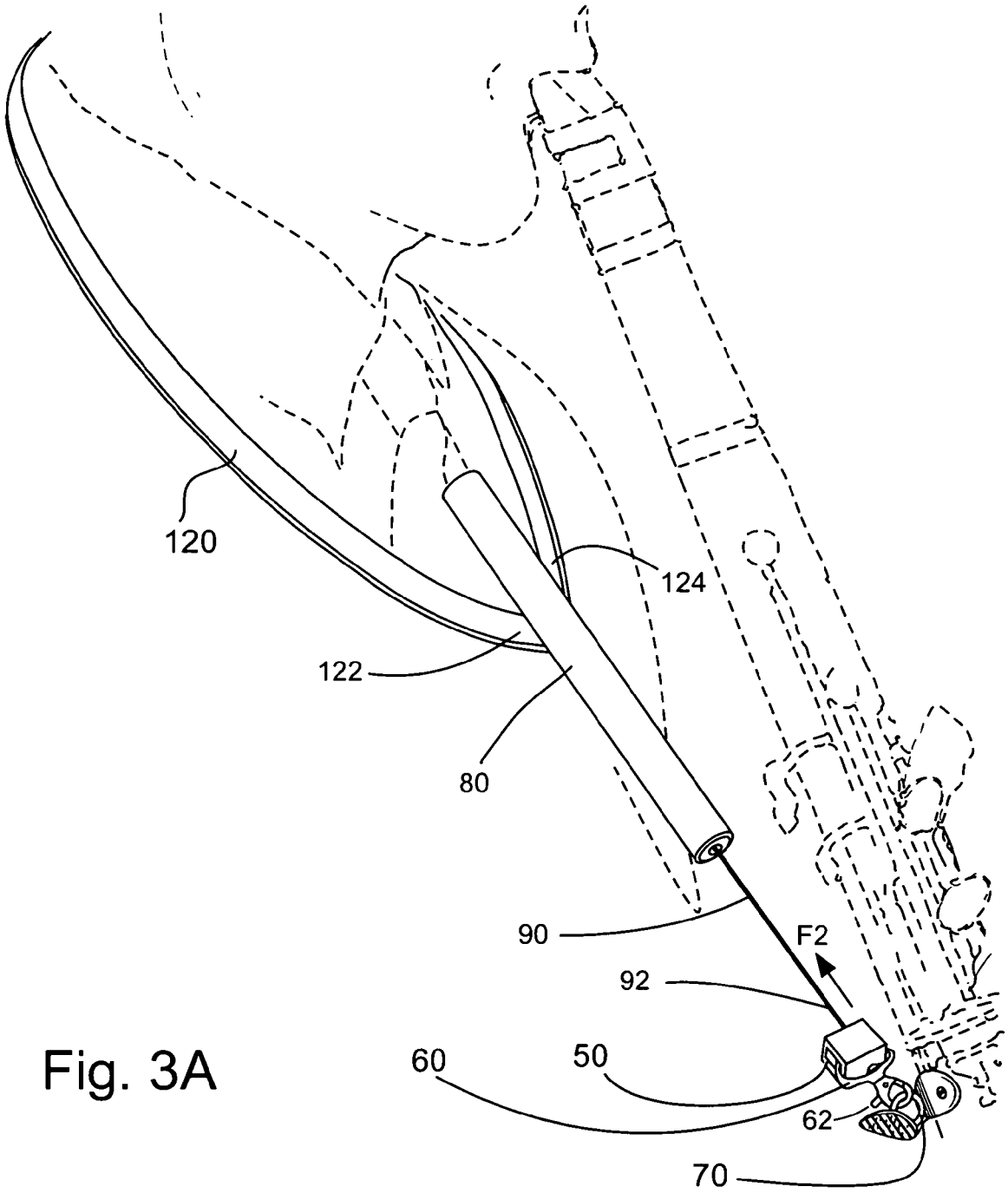
FIG. 3A shows a second embodiment of the application.
Figure 3B:
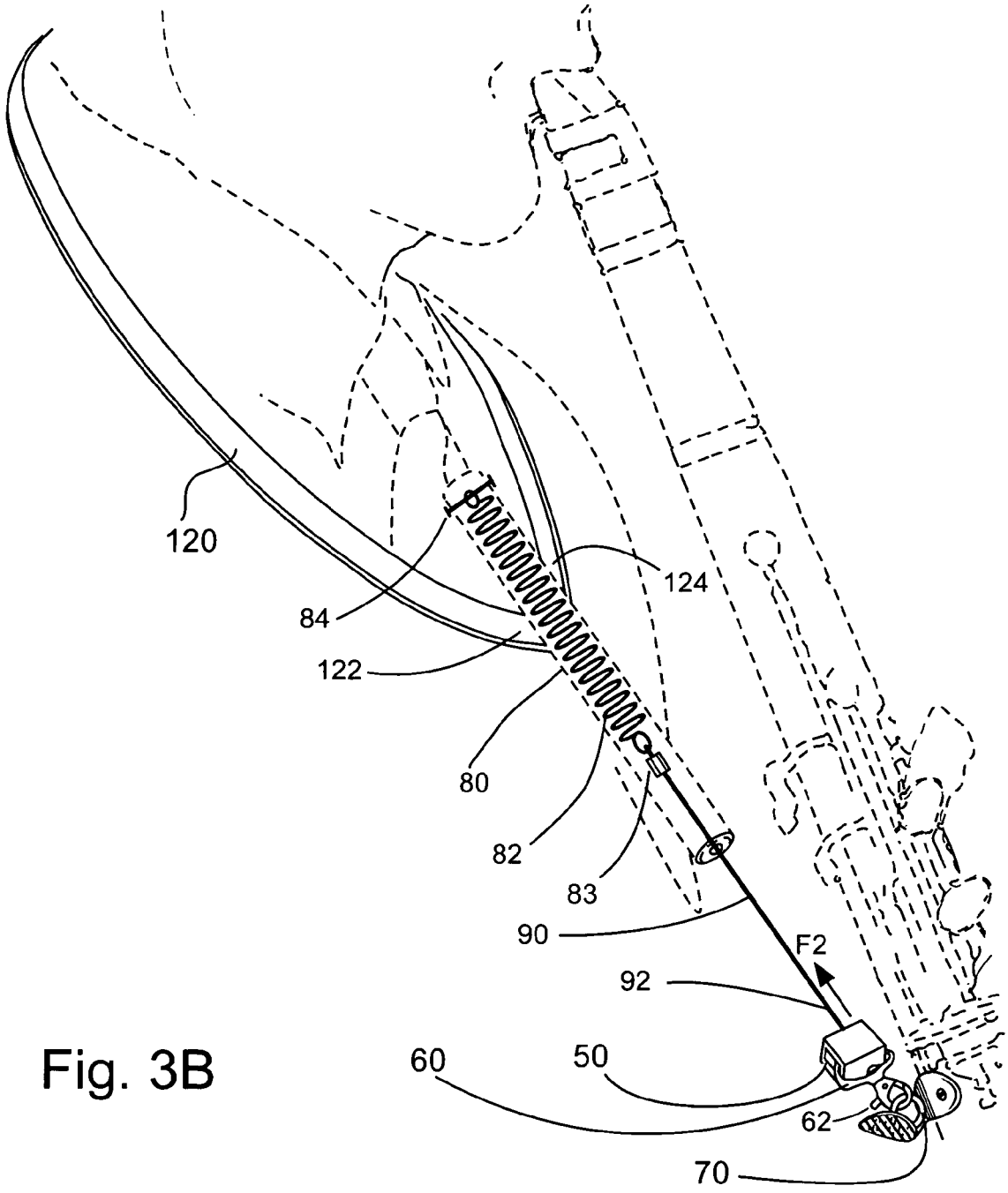
FIG. 3B shows the details of one implementation of this second embodiment.
Figure 3C:
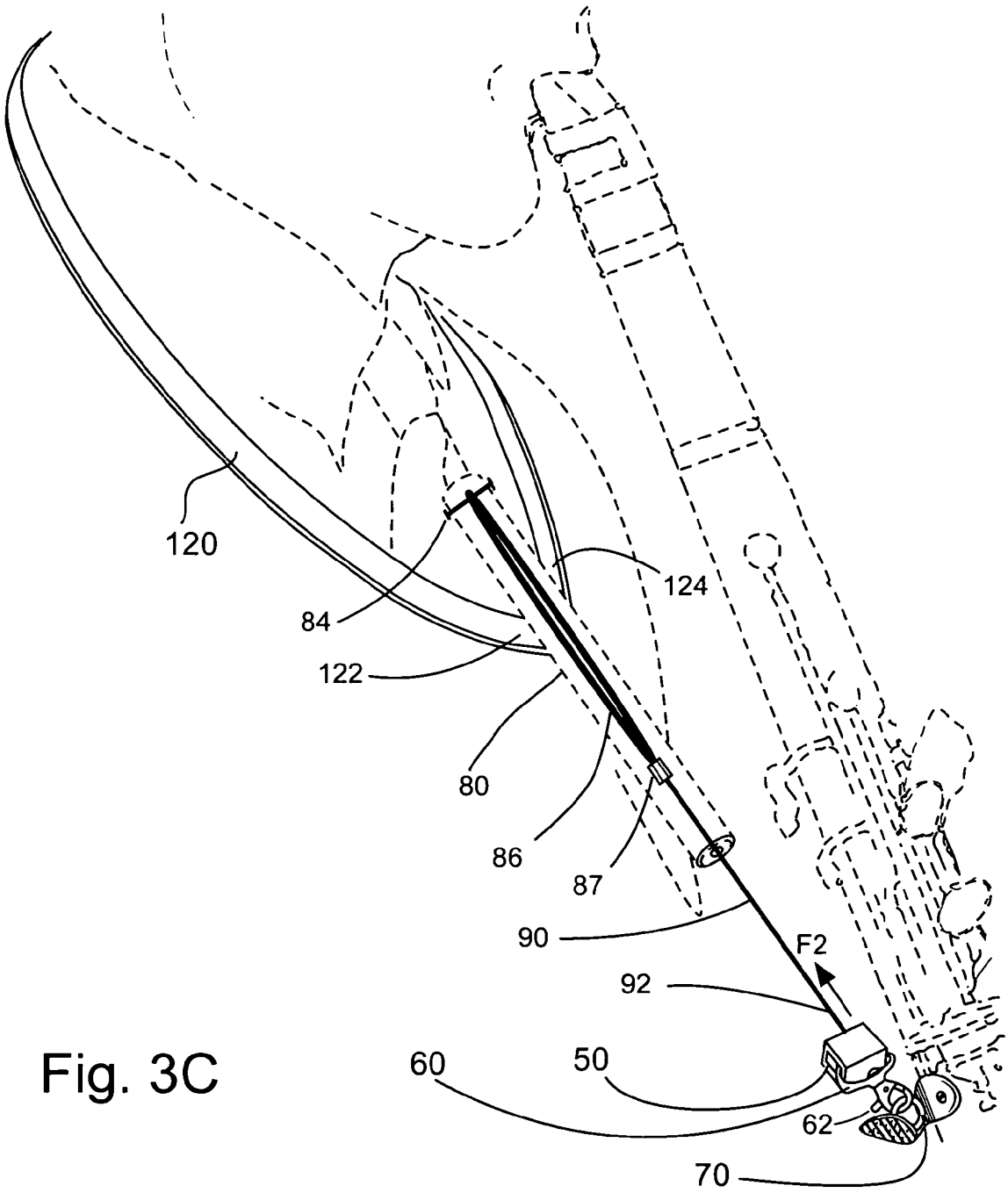
FIG. 3C shows the details of another implementation of this second embodiment.

Another embodiment of the application is depicted in FIG. 3A. This figure shows another way of providing the weight relief on the thumbrest comprising a strap 120 suspending around the neck of a player an elongated cylindrical tubing 80 by way of its two ends 122 and 124 attachments (not shown). This tubing is of any convenient section such as square, rectangular, triangular or preferably circular as depicted in FIG. 3A, 3B or 3C. Tubing 80 houses inside a practical arrangement that exerts a suitable pulling force F2 on a cord 90 via its end inside the tubing (not shown) that in turn will exert a pulling force on its other end 92 attached securely onto snap-hook base 50 that will exert ultimately on the thumbrest ring 70 pulling force F2 via snap-hook 60 similar to the one assembly used in the first embodiment shown in FIG. 2A. Cord 90 is made of similar material as cord 40 of FIG. 2A.

FIG. 3B shows one such practical arrangement comprising an extension spring 82 of such characteristic as to provide the suitable pulling force F2 on the thumbrest ring 70 when extended to a certain length. Spring 82 has at one of its ends a loop engaged through an anchor 84 to be limited to the upper end of tubing 80. The remaining end of spring 82 has a loop secured to one end of cord 90 inside the tubing by way of a loop of cord 90 and a mechanical attachment such as crimping 83.

FIG. 3C shows another such practical arrangement comprising an elongated loop 86 of elastically extensible material characterized by silicone, latex, neoprene rubber or better still, a material of high elasticity and durability such as the synthetic fiber known with the trade name Lycra or Spandex. The upper end of the elongated loop 86 is engaged through anchor 84 to be limited to the upper end of tubing 80. The remaining end of loop 86 is secured to one end of cord 90 inside the tubing by way of a loop of cord 90 and a mechanical attachment such as crimping 87 suitably made so that not so much pressure on the loop is concentrated at the point of attachment. Loop 86 is to provide the suitable pulling force F2 on the thumbrest ring 70 when extended to a certain length.

The suitable pulling force F2 on the thumbrest ring 70 when spring 82 of FIG. 3B or elongated loop 86 of FIG. 3C is extended to a certain length is calibrated similar to the pulling force F1 shown in FIG. 2A to be always less than the weight of the instrument by a calculated amount to provide the beneficial weight relief on the thumbrest in all practical playing angles of the instrument pointing to the ground. The only exception is that F2 can be only designed practically for a relatively narrow range of extends of cord 90. This range is enough to cover one-same-embodiment-for-all-sizes-of-players desirability, but not the extend that would allow walking, instrument on hand with arm fully extended, or resting the instrument on the knees, when the instrument is secured at the thumbrest to the embodiment which is already set up for playing.

FIG. 4

Another Embodiment

Figure 4:
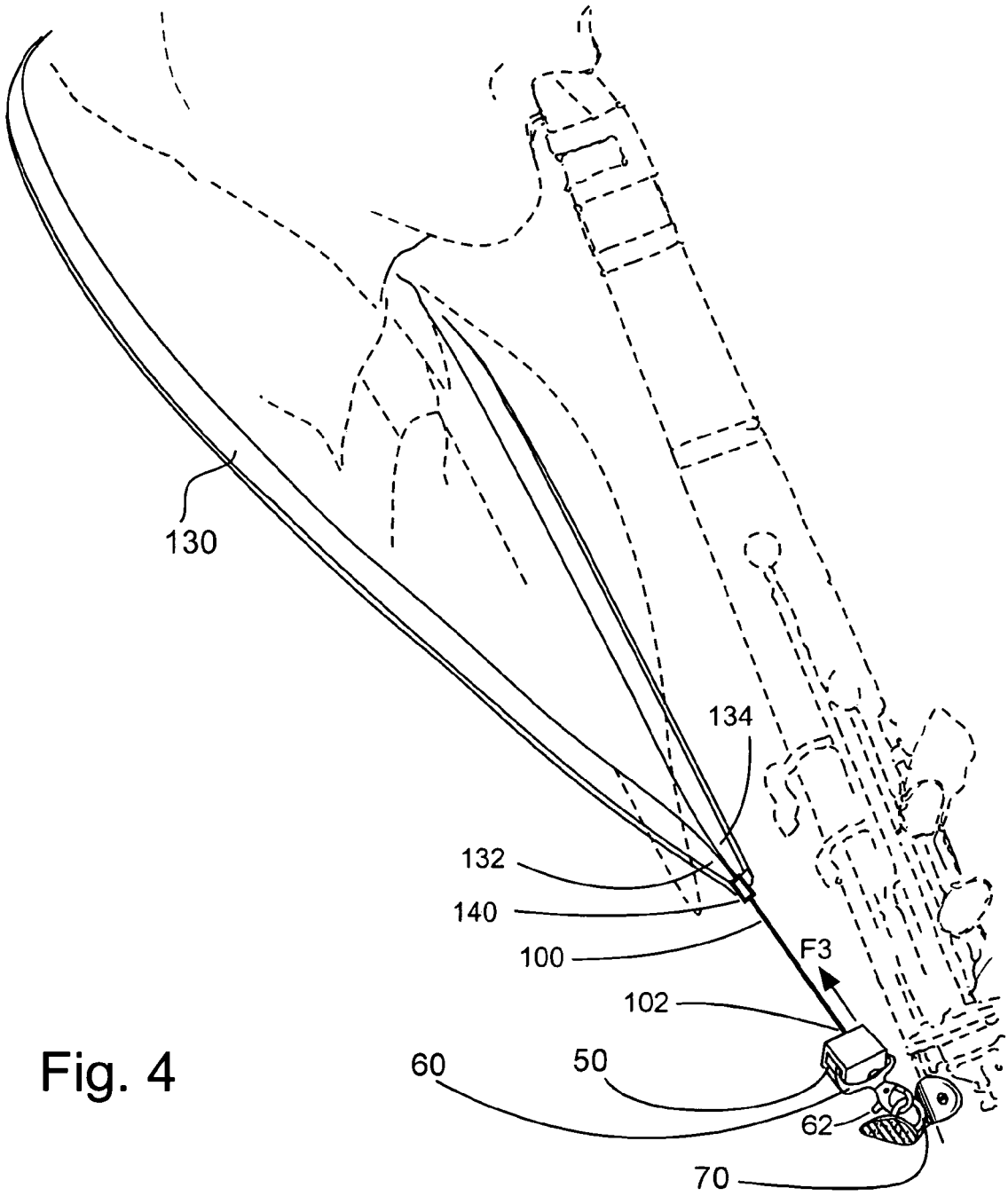
FIG. 4 shows a third embodiment of the application.

FIG. 4 shows another embodiment comprising a strap 130 of elastically extensible material characterized by silicone, latex, neoprene rubber or better still, a material of high elasticity and durability such as the synthetic fiber known with the trade name Lycra or Spandex. The two ends 132 and 134 of this strap are secured together with one loop at one end of a cord 100 into a crimped assembly 140. The other end 102 of cord 100 is secured onto snap-hook base 50. Cord 100 is made of similar material as cord 40 of FIG. 2A. Strap 130 is made such that the loop created by the joint at crimp 140 is large enough to wrap around the neck of a player by slipping it through the player's head. Snap-hook base 50 is linked to snap-hook 60 and thumbrest ring 70 similarly to the way shown in FIG. 2A. Strap 130 and cord 100 are designed in such a way as to allow a player of any size to cause the elastic strap 130 to provide a suitable up-pulling force F3 on the thumbrest in all the practical playing positions.

The suitable up-pulling force F3 on the thumbrest ring 70 in FIG. 4 is calibrated similar to the pulling force F1 shown in FIG. 2A to be always less than the weight of the instrument by a calculated amount to provide the beneficial weight relief on the thumbrest in all practical playing angles of the instrument pointing to the ground. The only exception is that F3 can be only designed practically for a relatively narrow range of extends of snap-hook 60 from the back of the neck of the player. This range is enough to cover one-same-embodiment-for-all-sizes-of-players desirability, but not the extend that would allow walking, instrument on hand with arm fully extended, or resting the instrument on the knees, when the instrument is secured at the thumbrest to the embodiment which is already set up for playing.

FIG. 5

Alternative Embodiment

Figure 5:
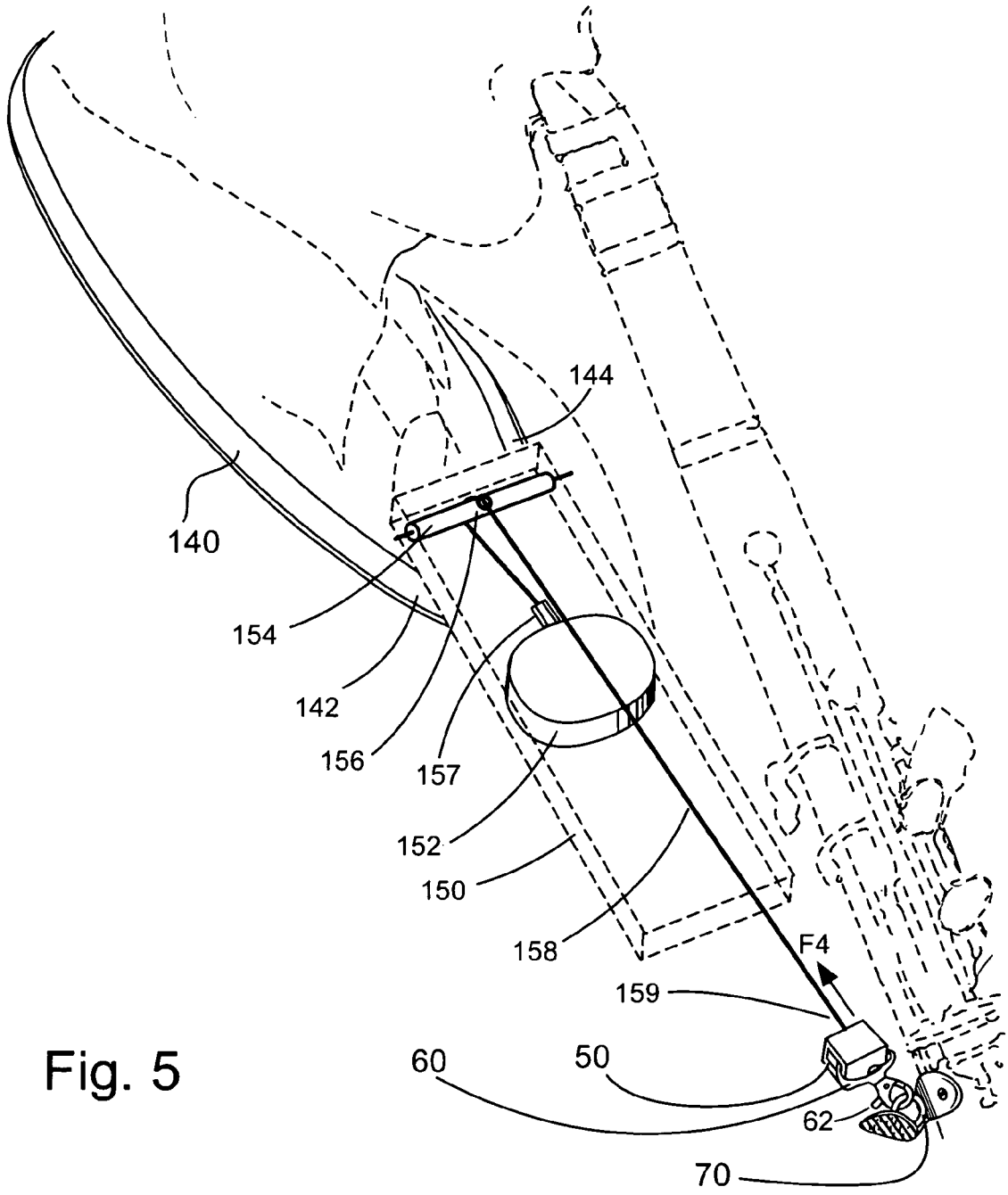
FIG. 5 shows a fourth embodiment of the application.

FIG. 5 shows another embodiment for providing the weight relief on the thumbrest. The weight-relieving device has a strap 140 of suitable width and length, and of suitable material to be comfortable in contact with the skin, at the same time strong, durable, flexible but not substantially extensible, and aesthetically blending into the look of the player and instrument. In the preferred embodiment, this strap is wrapped around the player's neck and one or both ends 142 and 144 of this strap can be easily and quickly secured onto or removed from a counter-weight housing 150 located on the chest of the player. This counter-weight housing can be made as a cylindrical enclosure of any shape; but for practical and aesthetic purpose, it will be made as a cylinder of rectangular section as shown in FIG. 5. A weight unit 152 made of a high-specific-mass material such as lead, can move freely along the longest rectilinear directions inside counter-weight housing 150. Weight unit 152 is attached by a crimping 157 at one end of cord 158 which is made of a material similar to that of cord 40 of FIG. 2A. The other end 159 of cord 158 exits the counter-weight housing 150 at an aperture 156 of housing 150, and ends up secured to snap-hook base 50 that will exert ultimately on the thumbrest ring 70 pulling force F4 via snap-hook 60 similar to the one assembly used in the first embodiment shown in FIG. 2A. Before exiting housing 150, cord 158 wraps itself around the rolling rod 154 which rotates freely around its longitudinal axis inside housing 150 when cord end 159 is moved farther or closer to aperture 156. Due to gravity force on weight unit 152, the reader can see that the arrangement in FIG. 5 will provide an up-pulling force on the thumbrest ring.

Strap 140, housing 150, weight unit 152, and cord 158, are designed in such a way as to allow a player of any size to cause the embodiment to provide a suitable up-pulling force F4 on the thumbrest in all the practical playing positions.

The suitable up-pulling force F4 on the thumbrest ring 70 in FIG. 5 is calibrated similar to the pulling force F1 shown in FIG. 2A to be always less than the weight of the instrument by a calculated amount to provide the beneficial weight relief on the thumbrest in all practical playing angles of the instrument pointing to the ground when cord end 159 is extended through a range of lengths. The only exception is that F4 can be only designed practically for a relatively narrow range of extends of snap-hook 60 from aperture 156. This range is enough to cover one same-embodiment-for-all-sizes-of-players desirability, but not the extend that would allow walking, instrument on hand with arm fully extended, or resting the instrument on the knees, when the instrument is secured at the thumbrest to the embodiment which is already set up for playing. Another exception is the fact that this embodiment adds the noticeable force of the weight unit 152, beyond anything else inherent with the first embodiment, to the stressing force on the neck of the player during playing. However, this additional amount of stressing force still is bearable by a player; or it can be alleviated with additional padding on the strap 140 (not shown).

FIG. 6

Another Alternative Embodiment

Figure 6:
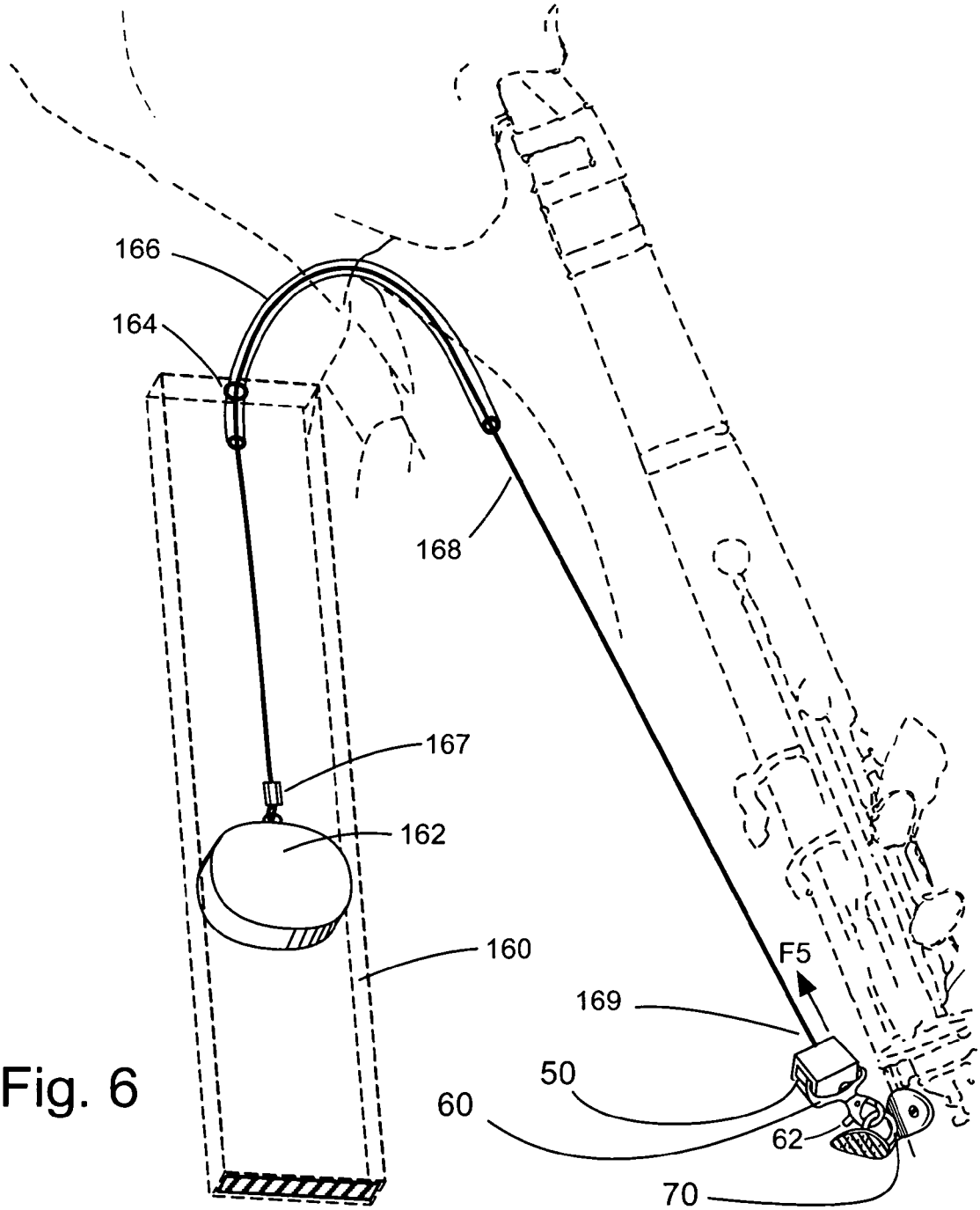
FIG. 6 shows a fifth embodiment of the application.

FIG. 6 shows another embodiment of providing the weight relief on the thumbrest. The weight-relieving device has a strap (not shown) that can be easily and quickly secured onto or removed from a counter-weight housing 160 to be located on the back of the player. This counter-weight housing can be made as a cylindrical enclosure of any shape; but for practical and aesthetic purpose, it will be made as a cylinder of rectangular section as shown in FIG. 6. Counter-weight housing 160 can be made similar to counter-weight housing 150 of FIG. 5, but beneficially longer. A weight unit 162 made of a high-specific-mass material such as lead, can move freely along the longest rectilinear directions inside counter-weight housing 160. Weight unit 162 is attached by a crimping 167 at one end of cord 168 which is made of a material similar to that of cord 40 of FIG. 2A. The other end 169 of cord 168 exits the counter-weight housing 160 by sliding back and forth inside a low-friction flexible tubing 166 which emerges from counter-weight housing 160 at an aperture 164 of housing 160. Tubing 166 can be made of commercially-available 90-durometer vinyl or natural polyethylene. The other end 169 of cord 168 is secured to snap-hook base 50 that will exert ultimately on the thumbrest ring 70 a pulling force via snap-hook 60 similar to the one assembly used in the first embodiment shown in FIG. 2A. Flexible tubing 166 guides cord 168 which slides freely inside it, around, for example, the right shoulder of the player. Due to gravity force on weight unit 162, the reader can see that the arrangement in FIG. 6 will provide an up-pulling force on the thumbrest ring.

The length of counter-weight housing 160 and its-location-on the player's back, weight unit 162, and cord 168, are designed in such a way as to allow a player of any size to cause the embodiment to provide the suitable up-pulling force F5 on the thumbrest in all the practical playing positions.

The suitable up-pulling force F5 on the thumbrest ring 70 in FIG. 6 is calibrated similar to the pulling force F1 shown in FIG. 2A to be always less than the weight of the instrument by a calculated amount to provide the beneficial weight relief on the thumbrest in all practical playing angles of the instrument pointing to the ground when cord end 169 is extended through a range of distances from the player's neck. This range is enough to cover one-same-embodiment-for-all-sizes-of-players desirability. Due to the fact that counter-weight housing 160 is recommended to be located on the left side of the player's back, and thus hidden easily from the view of the player from the audience at a concert, the length of housing 160 can be made long enough to enable this range of distances to allow walking elegantly, instrument on hand in front of the chest or with arm fully extended, or resting the instrument on the knees, when the instrument is secured at the thumbrest to the embodiment which is already set up for playing. One exception is the fact that this embodiment adds the noticeable force of the weight unit 162, and also of housing 160 when it is made long enough, beyond anything else inherent with the first embodiment, to the stressing force on the shoulder of the player during playing. However, this additional amount of stressing force still is bearable by a player; or it can be alleviated with additional padding on the strap and on the flexible tubing that slings around the shoulder (not shown).

A further embodiment for weight relieving on the thumbrest can be envisioned for the less popular instruments that comparably have double the weight of the instruments in the most popular and numerous group which the first embodiment aims at supporting commercially. That is the case of the straight soprano saxophones as compared to the clarinets and oboes. This embodiment (not shown) can be realized economically with two units of the first embodiment of FIG. 2A located side by side on the chest of a player, with their snap-hook 60 secured around the same thumbrest ring of one of these instruments during the playing.

FIG. 7

Provision of a Thumbrest Ring for Use with all Embodiments

Where a thumbrest ring does not exist on any of the instruments supportable by the embodiments of this application, an innovative ring attachment provides, as part of the embodiments, a reliable thumbrest ring to take the place of ring 70 in FIGS. 2A, 3A, 3B, 3C, 4, 5, and 6.

Figure 7:
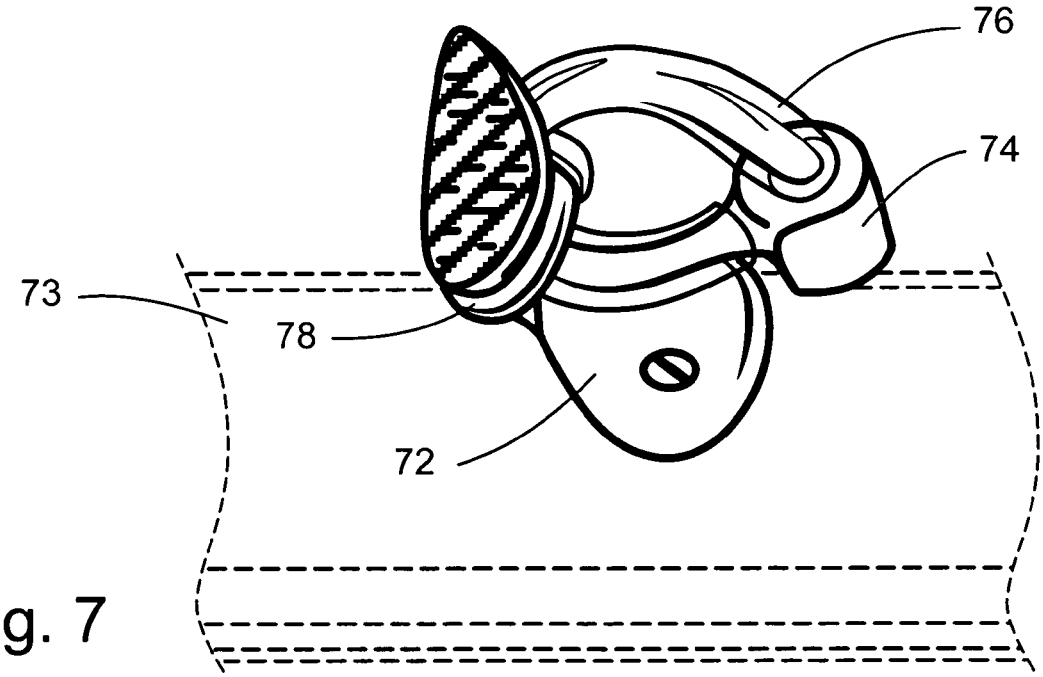

Referring to FIG. 7, this ring attachment comprises an essentially circular ring of nylon tie loop 74 enrobed with a plastic tubing 76, and secured onto a conventional thumbrest 72 with another nylon tying loop 78. Thumbrest 72 is shown already fixed onto the body 73 of an instrument as an example but not a necessity. Round loop 74 and tying loop 72 are preferably made with high-performance cable ties available under the trade name Ty-Rap. These ties are made with a good grade of nylon and have a built-in stainless-steel catch that allows a tying loop to stop at an infinite number of points along the body of the loop, and at the same time maintains the loop with proven great strength and durability. For tubing 76, a commercially available 68-durometer vinyl is preferable as soft enough to allow the tying loop 78 to do the best job in immobilizing securely the round loop 74 onto the upper surface of the thumbrest, and at the same time, hard enough to work properly with snap-hook 60 of all embodiments.

ADVANTAGES

From the description above, a number of advantages of my weight-relieving device for woodwind instruments become evident:

[a] When made within the suitable design measurements, all embodiments of this application satisfy the primary goal of relieving in a perceivable manner the deleterious instrument weight pressure on the right thumb of the player of an instrument of the group that does not have a curved neck near the mouthpiece such as an oboe, a clarinet, an oboe d'amore, an English horn, a basset clarinet or a straight soprano saxophone.

[b] The beneficial relieving of the deleterious pressure of the thumbrest on the right thumb by the weight of instrument is achieved with all embodiments of my invention while freeing the player to walk around the place or to move any body part instinctively when the player's spirit is in tune with the music. The benefit of weight relieving is there, yet the player still continues to enjoy the familiar raising of the instrument into playing position at any random angle of the instrument with respect to the player's body, as well as to enjoy all the techniques and habits of playing the instrument in any familiar position, usually with the instrument pointing to the ground.

[c] When made within the suitable design measurements, all embodiments present no danger for the player in jamming involuntarily the reed into the lips or teeth as with a fixed-length strap or an elastic strap which is designed in a way that has a pulling force toward the embouchure far beyond the weight of the instrument on the thumbrest at any instrument angle other than a unique and elusive optimum angle that is supposed to provide the weight relief at the thumbrest.

[d] Most if not all embodiments of this application can be appreciated as aesthetic, inconspicuous, non-intrusive, and artistically blending into the instrument and body of a player during a playing session.

[e] All embodiments come with one size-fits-all for any player of any age group, with no extra adjustments to be made.

[f] All embodiments are inexpensive and simple to make and to use, reliable, durable and fast in set up before use.

[g] No modifications on the instruments before one embodiment is put into use.

[h] When an instrument's thumbrest does not have a built-in ring to be used with any of the embodiment, a ring attachment will come as part of the embodiment that can be securely put on the thumbrest in a few minutes to provide a reliable and durable ring for use with the embodiment. Such ring attachment will not alter in any way the familiar feel of the thumb on the thumbrest, nor would it prevent all the parts of the instrument from being put back into its original case. This innovative ring attachment will save a player from the agony of having to spend a lot of time and money to have a metal ring soldered onto the thumbrest before being able to enjoy the benefits of this invention.

[i] Some of the embodiments allow the extra benefits of going naturally and elegantly on stage, instrument on hand in front of the chest or with arm fully extended, or resting the instrument on the knees while waiting to play again, when the instrument is secured at the thumbrest to the embodiment which is already set up for playing.

CONCLUSION, RAMIFICATIONS, AND SCOPE

Accordingly, the reader will see that the embodiments of this invention can be used to relieve the deleterious weight on the right thumb of a player of an instrument of the particular group that does not have a curved neck near the mouthpiece such as an oboe, a clarinet, an oboe d'amore, an English horn, a basset clarinet or a straight soprano saxophone. These effective embodiments point to a general method of relieving the weight on the right thumb of a player of an instrument of this group. This general method can have ramifications into other possible variations that would provide most if not all the benefits of the first embodiment of this application. For example, an embodiment (not shown) can provide a suitable up-pushing force on the thumbrest that creates physically a component force in line with but opposite to the gravity force of the weight of the instrument on the thumbrest, and thus will diminish the weight gravity force by an intended amount to provide a perceivable relief on the right thumb of the player. A mechanical arrangement that can provide this up-pushing force can be considered technically as a force potential source.

This up-pushing force is calibrated to be always less than the weight of the instrument by a calculated amount to provide the beneficial weight relief on the thumbrest in all practical playing angles of the instrument pointing to the ground.

Instead of a suitable up-pulling force on top of the thumbrest, this embodiment can be designed to provide equivalently a suitable up-pushing force on a snap-hook secured onto a ring located on top of the thumbrest which in turn will elevate the thumbrest by that up-pushing force to counter the down-pushing force of the weight of the instrument on top of the thumbrest. This last snap-hook is similar to snap-hook 60 and this last ring is similar to ring 70 of the first embodiment in FIG. 2A.

This last embodiment can be implemented as a two-bar linkage jointed together at one single pivoting pin at the apex of a V-shape linkage (not shown). The two arms of this V-shape linkage are urged for example by a torsion spring to spread themselves away from each other with a suitable torque. One extremity of the V-shape linkage is stably resting on an area around the abdomen of the player; and the other extremity of the V-shape linkage is secured to the last snap-hook. This suitable torque will exert the suitable up-pushing force on this last snap-hook in all practical playing angles of the instrument to provide the beneficial weight relief on the right thumb of the player.

This last embodiment can be implemented also as a cylindrical tube (not shown) containing inside a compression spring designed to provide a pushing force when compressed. This cylindrical tube is closed at one end to limit one end of this compression spring to the inside of the tube. It has an aperture at the other end to allow the pushing force of this compression spring to be transferred securely and efficiently out of the tube and onto this last snap-hook by way of a rod, for instance. When the closed end of the tube is stably resting on an area around the abdomen of the player, and when the pushing force and the lengths of the tube and of the rod are suitably designed, this force will serve as the suitable up-pushing force on the snap-hook to provide the beneficial weight relief on the right thumb of the player in all practical playing angles of the instrument.

The up-pushing force of these last two embodiments is calibrated to be always less than the down-pushing force of the weight of the instrument at the thumbrest by a calculated amount. This force calibration is done for all practical playing angles of the instrument so that these last variations of embodiment provide all the benefits of the first embodiment except the ones provided by the great extensions of cord 40 of the first embodiment.

Although the description above contains many specificities, these should not be construed as limiting the scope of the invention but as merely providing illustrations of some of the presently preferred embodiments of this invention.

Thus the scope of the invention should be determined by the appended claims and their equivalents, rather than by the examples given.

What I claim is:

1. A weight relieving device for a woodwind musical instrument being played by a player who supports said instrument by conventionally positioning said player's right thumb against a lower surface of the instrument thumbrest, comprising:

(a) a force potential source;

(b) means for linking said force potential source to a snap-hook to exert on said snap-hook a pulling force to move said snap-hook to a point as close as possible to the center of said force potential source when allowed to;

(c) said pulling force being calibrated to be always less than the force of the weight of the instrument by a calculated amount;

(d) means for pivotably securing releasably said snap-hook to the upper surface of said thumbrest;

(e) means for securing releasably an identifiable point of said force potential source a relatively fixed distance from a chosen body part of said player of the instrument;

whereby, in all usual playing positions that point the instrument to the ground, said chosen body part will enable said pulling force to create physically a component force in line with but opposite to the gravity force of the weight of the instrument on said thumbrest, and thus will diminish said gravity force by an intended amount to provide a perceivable relief on the right thumb of said player.

2. A weight relieving device for a woodwind musical instrument as defined in claim 1 wherein said woodwind musical instrument is one of a particular group of instruments that include an oboe, a clarinet, an oboe d'amore, an English horn, a basset clarinet and a straight soprano saxophone.

3. A weight relieving device for a woodwind musical instrument as defined in claim 2 wherein said means for linking said force potential source to a snap-hook is a cord made of material and technology to be strong and flexible enough to support durably in multiple times the weight of a typical instrument of said group.

4. A weight relieving device for a woodwind musical instrument as defined in claim 3 wherein said force potential source is the housing of said cord and a coil of flat spring material configured as a constant-force spring, and said chosen body part of said player of the instrument is the area around said player's neck.

5. A weight relieving device for a woodwind musical instrument as defined in claim 3 wherein said force potential source is an elongated tubing containing an extension spring, and said chosen body part of said player of the instrument is the area around said player's neck.

6. A weight relieving device for a woodwind musical instrument as defined in claim 3 wherein said force potential source is an elongated tubing containing an elongated loop of elastically extensible material, and said chosen body part of said player of the instrument is the area around said player's neck.

7. A weight relieving device for a woodwind musical instrument as defined in claim 3 wherein said force potential source is an elongated loop of elastically extensible material, and said chosen body part of said player of the instrument is the area around said player's neck.

8. A weight relieving device for a woodwind musical instrument as defined in claim 3 wherein said force potential source is a cylindrical enclosure preferably of rectangular section housing therein a weight unit of high-specific-mass material, and said chosen body part of said player of the instrument is the area around said player's neck.

9. A weight relieving device for a woodwind musical instrument as defined in claim 3 wherein said force potential source is a cylindrical enclosure preferably of rectangular section housing therein a weight unit of high-specific-mass material, and said chosen body part of said player of the instrument is the area around said player's back.

10. A weight relieving device for a woodwind musical instrument as defined in claim 1 wherein said means for pivotably securing releasably said snap-hook to the upper surface of said thumbrest is a metal ring soldered or brazed onto the upper surface of said thumbrest.

11. A weight relieving device for a woodwind musical instrument as defined in claim 1 wherein said means for pivotably securing releasably said snap-hook to the upper surface of said thumbrest is an essentially circular ring of nylon tie loop enrobed with a plastic tubing of chosen durometer, and securely immobilized onto the upper surface of said thumbrest with another nylon tie loop.

12. A method of relieving the weight of a woodwind musical instrument on the thumbrest of said instrument being played by a player who supports said instrument by conventionally positioning said player's right thumb against a lower surface of the instrument thumbrest, comprising:

(a) providing a force potential source;

(b) providing a means for linking said force potential source to a snap-hook to exert on said snap-hook a pushing force to move said snap-hook to a point as far as possible from the center of said force potential source when allowed to;

(c) said pushing force being calibrated to be always less than the force of the weight of the instrument by a calculated amount;

(d) providing a means for pivotably securing releasably said snap-hook to the upper surface of said thumbrest;

(e) providing a means for securing releasably an identifiable point of said force potential source to rest stably on a chosen body part of said player of the instrument such as the abdomen area;

whereby, in all usual playing positions that point the instrument to the ground, said chosen body part will enable said pushing force to create physically a component force in line with but opposite to the gravity force of the weight of the instrument on said thumbrest, and thus will diminish said gravity force by an intended amount to provide a perceivable relief on the right thumb of said player.

13. A method of relieving the weight of a woodwind musical instrument as defined in claim 12 wherein said woodwind musical instrument is one of a particular group of instruments that include an oboe, a clarinet, an oboe d'amore, an English horn, a basset clarinet and a straight soprano saxophone.

14. A method of relieving the weight of a woodwind musical instrument as defined in claim 12 wherein said means for pivotably securing releasably said snap-hook to the upper surface of said thumbrest is a metal ring soldered or brazed onto the upper surface of said thumbrest.

15. A method of relieving the weight of a woodwind musical instrument as defined in claim 12 wherein said means for pivotably securing releasably said snap-hook to the upper surface of said thumbrest is an essentially circular ring of nylon tie loop enrobed with a plastic material of chosen durometer, and securely immobilized onto the upper surface of said thumbrest with another nylon tie loop.

16. A method of relieving the weight of a woodwind musical instrument as defined in claim 12 wherein said force potential source is a V-shape, two-bar linkage, and said means for linking said force potential source to a snap-hook is one of the extremities of said linkage, and said means for securing releasably an identifiable point of said force potential source to rest stably on a chosen body part of said player is the other extremity of said linkage.

17. A method of relieving the weight of a woodwind musical instrument as defined in claim 12 wherein said force potential source is a cylindrical tube with a closed end, said cylindrical tube containing inside a compression spring, and said means for linking said force potential source to a snap-hook is a rod, and said means for securing releasably an identifiable point of said force potential source to rest stably on a chosen body part of said player is said closed end of said cylindrical tube.

* * * * *